US006777671B2

(12) United States Patent
Doroshenko

(10) Patent No.: US 6,777,671 B2
(45) Date of Patent: Aug. 17, 2004

(54) TIME-OF-FLIGHT/ION TRAP MASS SPECTROMETER, A METHOD, AND A COMPUTER PROGRAM PRODUCT TO USE THE SAME

(75) Inventor: Vladimir M. Doroshenko, Ellicott City, MD (US)

(73) Assignee: Science & Engineering Services, Inc., Burtonsville, MD (US)

( * ) Notice: Subject to any disclaimer, the term of this patent is extended or adjusted under 35 U.S.C. 154(b) by 429 days.

(21) Appl. No.: 09/828,828

(22) Filed: Apr. 10, 2001

(65) Prior Publication Data

US 2002/0145109 A1 Oct. 10, 2002

(51) Int. Cl.[7] ..... H01J 49/06; B01D 59/44

(52) U.S. Cl. ..... 250/287; 250/281; 250/282; 250/288; 250/292; 250/298

(58) Field of Search ..... 250/287, 281, 250/282, 288, 292, 298

(56) References Cited

U.S. PATENT DOCUMENTS

| | | | | | |
|---|---|---|---|---|---|
| 2,939,952 | A | | 6/1960 | Paul et al. | |
| 3,065,640 | A | | 11/1962 | Langmuir et al. | |
| 4,531,056 | A | * | 7/1985 | Labowsky et al. | 250/288 |
| 4,540,884 | A | * | 9/1985 | Stafford et al. | 250/282 |
| 4,882,484 | A | | 11/1989 | Franzen et al. | |
| 5,107,109 | A | * | 4/1992 | Stafford et al. | 250/282 |
| 5,202,563 | A | * | 4/1993 | Cotter et al. | 250/287 |
| 5,399,857 | A | * | 3/1995 | Doroshenko et al. | 250/292 |
| 5,464,985 | A | | 11/1995 | Cornish et al. | |
| 5,714,755 | A | * | 2/1998 | Wells et al. | 250/281 |
| 5,814,813 | A | * | 9/1998 | Cotter et al. | 250/287 |
| 5,965,884 | A | | 10/1999 | Laiko et al. | |
| 6,348,688 | B1 | * | 2/2002 | Vestal | 250/287 |
| 6,483,109 | B1 | * | 11/2002 | Reinhold et al. | 250/292 |
| 6,534,764 | B1 | * | 3/2003 | Verentchikov et al. | 250/287 |
| 6,570,152 | B1 | * | 5/2003 | Hoyes | 250/287 |
| 6,570,153 | B1 | * | 5/2003 | Li et al. | 250/292 |
| 6,586,727 | B2 | * | 7/2003 | Bateman et al. | 250/282 |
| 2001/0054684 | A1 | * | 12/2001 | Park | 250/287 |
| 2002/0145109 | A1 | * | 10/2002 | Doroshenko | 250/287 |
| 2002/0166961 | A1 | * | 11/2002 | Berggren et al. | 250/288 |
| 2002/0182649 | A1 | * | 12/2002 | Weinberger et al. | 435/7.9 |
| 2003/0028932 | A1 | * | 2/2003 | Skilling | 930/10 |
| 2003/0042412 | A1 | * | 3/2003 | Park | 250/281 |
| 2003/0178563 | A1 | * | 9/2003 | Makarov et al. | 250/288 |

FOREIGN PATENT DOCUMENTS

DE 944900 6/1956

OTHER PUBLICATIONS

Krutchinsky et al., "Orthogonal Injection of Matrix–assisted Laser Desorption/Ionization Ions into a Time–of–flight Spectrometer Through a Collisional Damping Interface", Rapid Commun. Mass Spectrom. 12 (1998) 508–518.*

(List continued on next page.)

*Primary Examiner*—John R. Lee
*Assistant Examiner*—Bernard Souw
(74) *Attorney, Agent, or Firm*—Oblon, Spivak, McClelland, Maier & Neustadt, P.C.

(57) ABSTRACT

A mass spectrometer includes an ion source, an extraction device, a TOF mass analyzer, an ion trap mass analyzer, and an ion guiding optical element which guides at least one of extracted ions from the ion source and extracted ion fragments into the TOF mass analyzer in a normal mode of operation and into the IT mass analyzer in a tandem mode of operation. The apparatus operates by producing ions from a sample, extracting the ions from the ion source, selecting between the TOF mass analyzer and the IT mass analyzer, directing extracted ions to the selected mass analyzer, mass-separating the directed ions and fragments of the directed ions according to a mass-to-charge ratio, detecting mass-separated ions with the selected mass analyzer, and producing at least one of a normal mass spectrum and a tandem mass spectrum.

76 Claims, 12 Drawing Sheets

OTHER PUBLICATIONS

W.C. Wiley et al., Time–of–Flight Mass Spectrometer with Improved Resolution, Dec. 1955, vol. 26, No. 12, The Review of Scientific Instruments, pp. 1150–1157.

A.F. Dodonov, et al., Electrospray Ionization on a Reflecting Time–of–Flight Mass Spectrometry, Chapter 7, American Chemical Society, Wash., DC, 1994, pp. 108–123.

Michael Karas et al., Laser Desorption Ionization of Proteins with Molecular Masses Exceeding 10 000 Daltons, Anal Chem. 1988, vol. 60, pp. 2299–2301.

Bernhard Spengler et al., Peptide Sequencing by Matrix–assisted Laser–desorption Mass Spectrometry, Rapid Comm. In Mass Spectrometry vol. 6, 1992, pp. 105–108.

Daniel R. Hardine, et al., A Tandem Time–of–flight Mass Spectrometer, Organic Mass Spectrom., 1992, vol. 27, pp. 1077–1083.

Kevin L. Schey et al., Ion/Surface Collision Phenomena In An Improved Tandem Time–Of–Flight Instrument, International Journal of Mass Spectrometry and Ion Processes, 1989, vol. 94, pp. 1–14.

Kevin L. Schey, et al., A Tandem Time–Of–Flight Mass Spectrometer For Surface–Induced Dissociation, International Journal of Mass Spectrometry, Ion Processes, 1987, vol. 77, pp. 49–61.

F.H. Strobel, et al., Detection of Femtomoe and Sub–femtomole Levels of Peptides by Tandem Magnetic Sector/Reflectron Time–of–Flight Mass Spectrometry and Matrix–Assisted Laser Desorption Ionization, J. Am. Soc. Mass Spectrom 1991, vol. 2, pp. 91–94.

F.H. Strobel, et al., Neutral–Ion Correlation Measurements: A Novel Tandem Mass Spectrometry Data Acquisition Mode for Tandem Magnetic Sector/Reflectron Time–of–Flight Instruments, Anal. Chem., 1992, vol. 64, pps. 754–762.

R. Weinkauf, et al., Laser Tandem Mass Spectrometry in a Time of Flight Instrument, International Journal Mass Spectrom Ion Processes, 1989, vol. 44a, pp. 1219–1225.

R. Graham Cooks, Ion Trap Mass Spectrometry, Special Report, C&EN, Mar. 25, 1991, pp. 26–41.

Vladimir M. Doroshenko, et al., Matrix–assisted Laser Desorption/Ionization inside a Quadruple Ion–Trap Detector Cell, Rapid Communications in Mass Spectrometry, 1992, vol. 6, pp. 753–757.

J.E. Crawford, et al., Laser Desorption Sources and Time–of–Flight Injection for RFQ Traps, Hyperfine Interactions, 1993, vol. 81, pp. 143–149.

Steven M. Michael, et al., An Ion Trap Storage/Time–of–Flight Mass Spectrometer, Rev. Science Instrum., Oct. 1992, vol. 63, pp. 4277–4284.

Th. L. Grebner, et al., Laser Produced Ions Stored in a Cylindrical Ion Trap and Detected in a Reflectron Time–of–Flight Mass Spectrometer, International Journal of Mass Spectrometry and Ion Processes, 1994, vol. 137, pp. L1–L6.

Vladimir M. Doroshenko et al., A Quadrupole Ion Trap/Time–of–Flight Mass Spectrometer with a Parabolic Reflection, Journal of Mass Spectrometry, 1998, vol. 33, pp. 305–318.

Andrej Shevchenko et al, Rapid 'de Novo' Peptide Sequencing by a Combination of Nanoelectrospray, Isotopic Labeling and a Quadrupole/Time–of–Flight Mass Spectrometer, Rapid Communications in Mass Spectrometry, 1997, vol. 11, pp. 1015–1024.

* cited by examiner

TIME-OF-FLIGHT/ION TRAP MASS SPECTROMETER, A METHOD, AND A COMPUTER PROGRAM PRODUCT TO USE THE SAME

STATEMENT REGARDING FEDERALLY SPONSORED RESEARCH OR DEVELOPMENT

The U.S. Government has certain rights in this invention as provided for in Grant Number 2R44 HG0 1968-02 awarded by the National Institutes of Health.

BACKGROUND OF THE INVENTION

1. Field of the Invention

The present invention relates to a time-of-flight/ion trap mass spectrometer, a method of operating the time-of-flight/ion trap mass spectrometer, and a computer program and a computer-program-product such as for example a hard drive or floppy disk or other medium containing computer code for operation of the time-of-flight/ion trap mass spectrometer.

2. Description of the Background

A mass spectrometer (MS) is used to determine the identity and quantity of constituent materials in a gaseous, liquid or solid specimen.

In a normal mode of operation, specimens are analyzed in mass spectrometers by ionizing the molecules of the specimen in an ion source, separating ions according to their mass-to-charge ratio (m/z) in a mass analyzer, and bombarding the separated ions in an ion detector to obtain a mass spectrum. Typically, the ion mass m is expressed in atomic mass units or Daltons (Da) and the ion charge z is the charge on the ion in terms of the number of elementary charges e.

In a tandem mode of operation, the mass spectrometer includes a device that produces fragmentation of ions into smaller structure-specific ions for further mass analysis. A spectrum referred to as a tandem mass spectrum corresponding to the fragmented ions can be obtained. By repeating the isolation and fragmentation stages a multiple number of times, one can obtain a tandem mass spectrum in this tandem mode of operation in which the ions have been repeatedly fragmented through a number of MS stages, e.g., a $MS^n$ spectra is obtained (where $n \geqq 2$) which thereafter are also referred to as tandem mass spectra. In mass analysis of large biological molecules, tandem mass spectral measurements provide structural and sequential information about peptides and other biopolymers.

A time-of-flight (TOF) mass spectrometer (MS) is a known instrument for mass analysis in a normal mode. In TOF-MS, ions formed from sample molecules in an ion source are accelerated to the same energy and allowed to drift along a defined path before detection. Because ions of different mass have different velocity, after acceleration, they are separated in space during flight and in time during detection. Thus, the time of arrival to the detector is measure of the mass or the mass-to-charge ratio m/z, if ions are not singly-charged.

This picture can be complicated by the presence of non-ideal factors, which include: (a) different time of formation or acceleration of ions; (b) different initial location of ions in space; and (c) different initial velocity of ions before acceleration. A number of methods, such as for example time focusing, dual-stage extraction, and time-lag focusing, can be used to correct these factors. Time focusing can be achieved by using pulsed drawout fields with sharp rise times or short laser pulses in the case of laser desorption (LD) or matrix-assisted laser desorption/ionization (MALDI). Alternatively, a dual-stage extraction method can be used to correct the initial spatial distribution of ions in an ion source. Initial velocity (or energy) distribution can be corrected by a time-lag focusing technique (e.g. a pulsed or delayed or time-delayed extraction method) or an ion mirror method (e.g., a method utilizing a reflectron). In addition, orthogonal ion extraction which interfaces with continuous ionization sources such as electrospray ionization (ESI), as described in U.S. Pat. No. 4,531,056, the entire contents of which are incorporated herein by reference, can be used to reduce the impact of the non-ideal factors.

Conventional TOF-MS schemes are shown in FIGS. 1A–1D which are discussed below. Details on a TOF-MS are given in: R. J. Cotter, *Time-of-Flight Mass Spectrometry: Instrumentation and Applications in Biological Research*, ACS Professional Reference Books, Washington, D.C., 1997, pp. 1–327; W. C. Wiley, I. H. McLaren, *Rev. Sci. Instr.*, 1955, vol. 26, pp. 1150–1157; A. F. Dodonov, I. V. Chernushevich, V. V. Laiko, in *Time-of-Flight Mass Spectrometry*, Ed. R. J. Cotter, American Chemical Society, Washington, D.C., 1994, pp. 108–123, the entire contents of each reference are incorporated herein by reference.

Time-of-flight (TOF) mass spectroscopy has several advantages over other types of mass spectroscopy. A TOF mass spectrometer is conservative of the sample since every ion formed in the bunch is detected. Open flight tube designs in TOF mass spectrometers result in high ion transmittance due to a wide aperture to the source. There is no fundamental limit (other than detectability) on the range of analyzed m/z values. Due to the pulsed nature of the TOF technique, the TOF mass spectrometer can be interfaced to pulsed ion sources; importantly, it can be interfaced, as shown in FIGS. 1A–1C, to vacuum MALDI ion sources which are widely utilized for the ionization of large biological molecules as described in M. Karas, F. Hillenkamp, *Anal. Chem.* 1988, vol. 60, pp. 2299–2301, the entire contents of which are incorporated herein by reference, and the afore-mentioned electrospray ionization sources.

FIG. 1A shows a linear TOF-MS in which a laser 100 desorbs an ionized species from a sample contained in a matrix-assisted laser desorption/ionization stage 102. The stage 102 exists at a high voltage potential adjacent to an extraction device 104. Ionized species are extracted from the region near the stage 102 and directed to an ion detector 106.

FIG. 1B shows a reflection TOF-MS similar to the TOF-MS in FIG. 1A, but where ions are directed by reflectron 108 to the ion detector 106 through a curved path. The reflection 108 includes a series of rings with each ring set progressively to higher potentials.

FIG. 1C shows a TOF-MS in which a pulsed voltage signal is applied to the stage 102 after the laser 100 produces the desorbed, ionized species. The pulse voltage signal time-focuses the desorbed ionized species to ensure that ions of a particular m/z value arrive at the ion detector simultaneously. Most commercial MALDI instruments use a TOF-MS as a mass analyzer.

Further, U.S. Pat. No. 5,965,884, the entire contents of which are incorporated herein by reference, describes an atmospheric pressure MALDI technique in which ions are formed outside the vacuum of a mass spectrometer at atmospheric conditions. FIG. 1D shows an orthogonal acceleration TOF-MS interfaced with an atmospheric ion source. Ions from the atmospheric ion source 110 pass through a heated capillary 112 and a skimmer 114 to produce a collimated ion beam. Once inside the vacuum of the orthogonal acceleration TOF-MS, electrostatic optics 116 focus the ion beam into a quadrupole 118 which homogenizes the ion beam such that ions exiting the quadrupole 118 have only an axial velocity component and almost no radial velocity. Deflection optics 120 deflect the exiting ions toward the reflectron 108 which in turn reflects the ions to the ion detector 106.

However, a drawback of TOF-MS technology is that TOF-MS does not easily provide for a tandem mode of operation. Yet, tandem experiments, by analysis of fragmentation patterns from complex molecules, can play a role in structural elucidation of biological molecules. This role of TOF-MS for MALDI analysis of biological molecules has led to the search for mechanisms to provide a tandem mode of operation in TOF-MS instruments.

In the tandem mode, the isolated ions (i.e., precursor ions) undergo an activation process to produce fragmented ions. Activation energy of the precursor ions can come from collisions with buffer gas or surfaces or photoexcitation. One approach, as shown in FIG. 2A and as described in U.S. Pat. No. 5,202,563, the entire contents of which are incorporated herein by reference, utilizes a tandem reflectron TOF instrument (reTOF/reTOF) with a collision chamber for providing activation and fragmentation. FIG. 2A shows a tandem reflectron mass spectrometer in which ions transit through two reflectrons 220 and 222 and a collision chamber 202 before arriving at the ion detector 106.

In another approach, as shown in FIG. 2B and as described in B. Spengler, D. Kirsch, R. Kaufmarn, E. Jaeger, *Rapid Commun. Mass Spectrom.,* 1992, vol. 6, pp. 105–108, the entire contents of which are incorporated herein by reference, a postsource decay (PSD) process fragments the ionized species. The fragmentation occurs as a part of the natural decay process via the residual energy remaining in the ionized species from the laser desorption/ionization event. FIG. 2B shows that ions extracted from the stage 102 pass through an ion gate 204 selecting ions of interest. The ion gate passes ions of interest which fragment due to PSD phenomenon before entering the reflectron 220, enabling subsequent separation and analysis of fragment ions at the ion detection 106.

In other approaches, product ions from the ion source are re-accelerated using two linear TOF mass analyzers (i.e., without reflectrons), as described in D. R. Jardine, J. Morgan, D. S. Alderdice, P. J. Derrick, *Org. Mass Spectrom.,* 1992, vol. 27, pp. 1077–1083 and K. L. Schey, R. G. Cooks, R. Grix, H. Wollnik, *Int. J Mass Spectrom. Ion Proc.,* 1987, vol. 77, pp. 49–61, the entire contents of each reference are incorporated herein by reference. Further, a linear/reflectron (TOF/RTOF) configuration has been described in K. L. Schey, R. G. Cooks, A. Kraft, R. Grix, H. Wollnik, *Int. J Mass Spectrom. Ion Proc.,* 1989, vol. 94, pp. 1–14, the entire contents of which are incorporated herein by reference.

Further, a hybrid sector/reflectron TOF instrument utilizing a double-focusing sector mass analyzer for mass selection and a reflectron TOF to record the product ions was used, as described in F. H. Strobel, T. Solouki, M. A. White, D. H. Russell, *J Am. Soc. Mass Spectrom.,* 1990, vol. 2, pp. 91–94 and in F. H. Strobel, L. M. Preston, K. S. Washburn, D. H. Russell, *Anal. Chem.,* 1992, vol. 64, pp. 754–762, the entire contents of which are incorporated herein by reference.

In a reflectron TOF (reTOF) mass analyzer, a focusing problem exists. Before fragmentation, product ions in the mass spectrometer have the same velocity as the precursor ions, but after fragmentation, the kinetic energy of the fragmented product ions differs from that of the precursor ions so that the reflectron which is a monochromatic device, i.e. a device designed to focus ions at one energy, does not focus all the fragmented ions. In one corrective approach, reflectron voltages are stepped to record different regions of the mass spectrum (e.g., scanning of the reflectron voltages), and a focused mass spectrum is reconstructed from a series of transient spectra, as described in R. Weinkauf, K. Walter, C. Weickhardt, U. Boesl, E. W. Schlag, Int. J. Mass Spectrom. Ion Processes, 1989, vol. 44a, pp. 1219–1225, the entire contents of which are incorporated herein by reference and in B. Spengler, D. Kirsch, R. Kaufmann, E. Jaeger, *Rapid Commun. Mass Spectrom.,* 1992, vol. 6, pp. 105–108, the entire contents of which has been previously incorporated herein by reference. Alternatively, a curved field reflectron as described in U.S. Pat. No. 5,464,985, the entire contents of which are incorporated by reference, improves the mass resolution for fragmented product ions.

An ion trap, as shown in FIG. 2C, has also been utilized as a front-end device on TOF-MS instruments. These instruments, referred to as IT/TOF-MS, are described in S. M. Michael, B. M. Chien, D. M. Lubman, *Rev. Sci. Instrum.,* 1992, vol. 63, 4277; T. L. Grebner, H. J. Neusser, *Int. J Mass Spectrom. Ion Proc.,* 1994, vol. 137, Li; Q. Ji, P. R. Vlasak, M. R. Davenport, C. G. Enke, J. F. Holland, *J Am. Soc. Mass Spectrom.,* 1996, vol. 7, 1009, and V. M. Doroshenko, R. J. Cotter, J Mass Spectrom., 1998, vol. 33, pp. 305–318, the entire contents of each reference are herein incorporated by reference.

An electrodynamic ion trap is a device consisting of several electrodes in which ions can be trapped in space for a long time by applying periodic or alternating potentials to one or several electrodes to generate an inhomogeneous-in-space trapping electric field. The ion trap (IT) of FIG. 2C consists of one annular ring electrode 206 and two ion-trap end-cap electrodes 208 and 210. A RF voltage is applied to the ring electrode 206 while the ion-trap end-cap electrodes 208 and 210 are grounded during most of the operational cycle time. The electric field inside the ion trap typically includes a main quadrupole field as well as higher order, weaker fields. Such an ion trap is commonly referred to as a quadrupole ion trap. Ions from an ion source are accumulated in the trap, fragmented inside the trap using normal ion trapping procedures (e.g., by resonant excitation and collisional activation), and extracted for mass analysis. The extracted ions (as shown in FIG. 2C) transit a curved path to the ion detector 106 by passing through a reflectron 220.

In contrast to a vast majority of tandem mass spectrometers typically called "tandem-in-space" mass spectrometers which include additional mass analyzers for isolating and analyzing ions, ion isolation and mass analyzing in an ion trap can be performed within the same volume of the mass spectrometer. For this reason, an ion trap is often referred to as a "tandem-in-time" mass spectrometer. Details on ion trap design and the operation of an ion trap as a mass spectrometer are described in: R. E. March, R. J. Hughes, *Quadrupole Storage Mass Spectrometry*, John Wiley & Sons, NY, N.Y., 1989, pp. 1–471; R. G. Cooks, G. L. Glish, S. A. McLuckey, R. E. Kaiser, "Ion Trap Mass Spectrometry", *C&EN,* 1991, March 25, pp. 26–41; and German Patent No. 944,900 and U.S. Pat. Nos. 2,939,952; 3,065,640; 4,540,884; 4,882,484; 5,107,109; and 5,714,755, the entire contents of each reference are incorporated herein by reference.

One advantage of ion-trap mass spectrometry is the ability of the ion-trap to perform tandem mass spectrometry. However, only a limited mass range is available due to a low-mass cut-off phenomenon at the low mass end and a decreasing trapping well depth at the high mass end. Also, mass assignment accuracy in a IT-mass spectrometer is compromised by space charge effects when there is a high population of the trapped ions in the ion trap. A variety of ionization sources have been interfaced with ion traps including MALDI sources, as described in V. M. Doroshenko, T. J. Cornish, R. J. Cotter, *Rapid Commun. Mass Spectrom.,* 1992, vol. 6, 753–757, the entire contents of which are incorporated herein by reference. Despite an effective method for injection of MALDI ions into the trap whereby RF voltages are ramped while ions are injected into the trap as described in U.S. Pat. No. 5,399,857, the entire contents of which are incorporated herein by reference, a MALDI ion trap mass spectrometer is still not available commercially due to the limited mass range of current ion trap devices.

Another related ion trapping method, applicable when injecting short duration ion beams, involves the application of pulsed retarding DC voltages to one of the ion trap electrodes for deceleration of injected ions as described in J. E. Crowford, F. Buchinger, L. Davey, Y. Ji, J. K. P. Lee, J. Pinard, J. L. Vialle, W. Z. Zhao, *Hyperfine Interact.,* 1993, vol. 81, p. 143, the entire contents of which are incorporated herein by reference.

In another approach, as shown in FIG. 2D, multiple quadrupoles as described in Chernushevich et al., *Rapid Commun. Mass Spectrom.,* 1997, vol. 11, pp. 1015–1024, the entire contents of which are incorporated by reference, were utilized in conjunction with an orthogonal extraction TOF instrument (i.e., a qqTOF configuration) to achieve a tandem mode of operation. FIG. 2D shows that a quadrupole section 212*a* provides ion isolation, a quadrupole section 212*b* provides fragmentation, and a quadrupole section 212*c* provides thermalization. However, only a limited mass range is realized in the qq-TOF configuration.

SUMMARY OF THE INVENTION

As discussed above, conventional time-of-flight mass spectroscopy fails to address the requirement for tandem operation needed for structural elucidation of biological molecules. Previous attempts to achieve tandem operation in TOF-MS are complicated (as in the TOF/TOF technique), limited in mass resolution, mass range, and/or sensitivity, or merely simulate a true tandem operation (as in the PSD process).

One object of this invention is to provide a method and apparatus for tandem mode of operation in time-of-flight mass spectrometry in such a way that the time-of-flight mass spectrometer of the present invention has high mass range, high mass accuracy for the mass assignment, and high mass resolution.

Another object of the present invention is to provide a novel mass spectrometer which combines high mass range and high mass resolution performance of TOF-MS with the tandem capabilities of an ion trap mass spectrometer.

Since a sharing of an ion source between a free-standing TOF-MS and a free-standing IT-MS is complicated by the requirements for high precision ion optics, another object of the present invention is to provide an integrated TOF-IT mass spectrometer in which an ion extraction device directs ions to one of a TOF or an IT mass analyzer. The TOF-IT mass spectrometer of the present invention configures an extraction device which directs extracted ions into the TOF mass analyzer in a normal mode and directs extracted ions into an IT mass analyzer in a tandem mode. As a result, the extraction device operates in both normal and tandem modes with performance uncompromised by the presence of an ion trap mass analyzer in the system.

These and other objects are provided for in a mass spectrometer which includes an ion source, an extraction device, a TOF mass analyzer, an ion trap mass analyzer, and an ion guiding optical element which guides at least one of extracted ions from the ion source and extracted ion fragments into the TOF mass analyzer in a normal mode of operation and into the IT mass analyzer in a tandem mode of operation. The apparatus operates by producing ions from a sample, extracting the ions from the ion source, selecting between the TOF mass analyzer and the IT mass analyzer, directing extracted ions to the selected mass analyzer, mass-separating the directed ions and fragments of the directed ions according to a mass-to-charge ratio, detecting mass-separated ions with the selected mass analyzer, and producing at least one of a normal mass spectrum and a tandem mass spectrum.

In the spectrometer of the present invention, ions generated from an ion source can be mass analyzed independently by two mass spectrometers in a normal or tandem mode of operation. In the normal mode, the mass spectrometer of the present invention utilizes time-of-flight spectroscopy to survey a broad range of atomic mass units (AMU) extracted from the ion source, such as for example 1–100,000 AMU. In the tandem mode, the mass spectrometer of the present invention utilizes ion-trap spectroscopy to promote fragmentation of predetermined mass ranges within the broad spectrum of extracted ions. For example, a biological sample shows in a normal mode a peak around 1,500 AMU attributed to a peptide ion from a family of proteins. Subsequent fragmentation of the peptide ion would yield mass spectra unique to a specific protein in that family. Thus, in this example, the mass spectrometer of the present invention is utilized to obtain broad spectral analysis and fragmentation of selected ions to yield protein identification.

The method of the present invention is advantageous for analyzing ions generated from matrix assisted laser desorption/ionization (MALDI) ion sources and electrospray ionization sources which produce intact ions of biomolecules in a broad mass range.

BRIEF DESCRIPTION OF THE DRAWINGS

A more complete appreciation of the present invention and many attendant advantages thereof will be readily obtained as the same becomes better understood by reference to the following detailed description when considered in connection with the accompanying drawings, wherein.

DESCRIPTION OF THE EMBODIMENTS

Figure 1A:
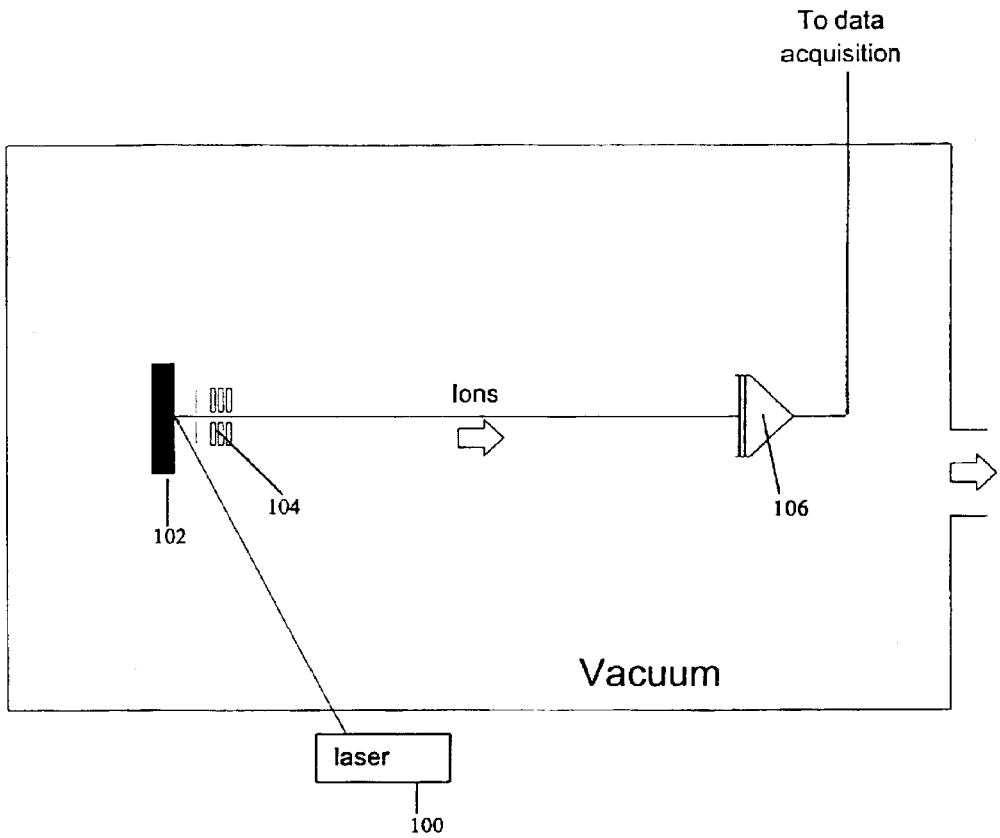
FIGURE 1A PRIOR ART
FIG. 1A is a schematic of a linear TOF-MS.
Figure 1B:
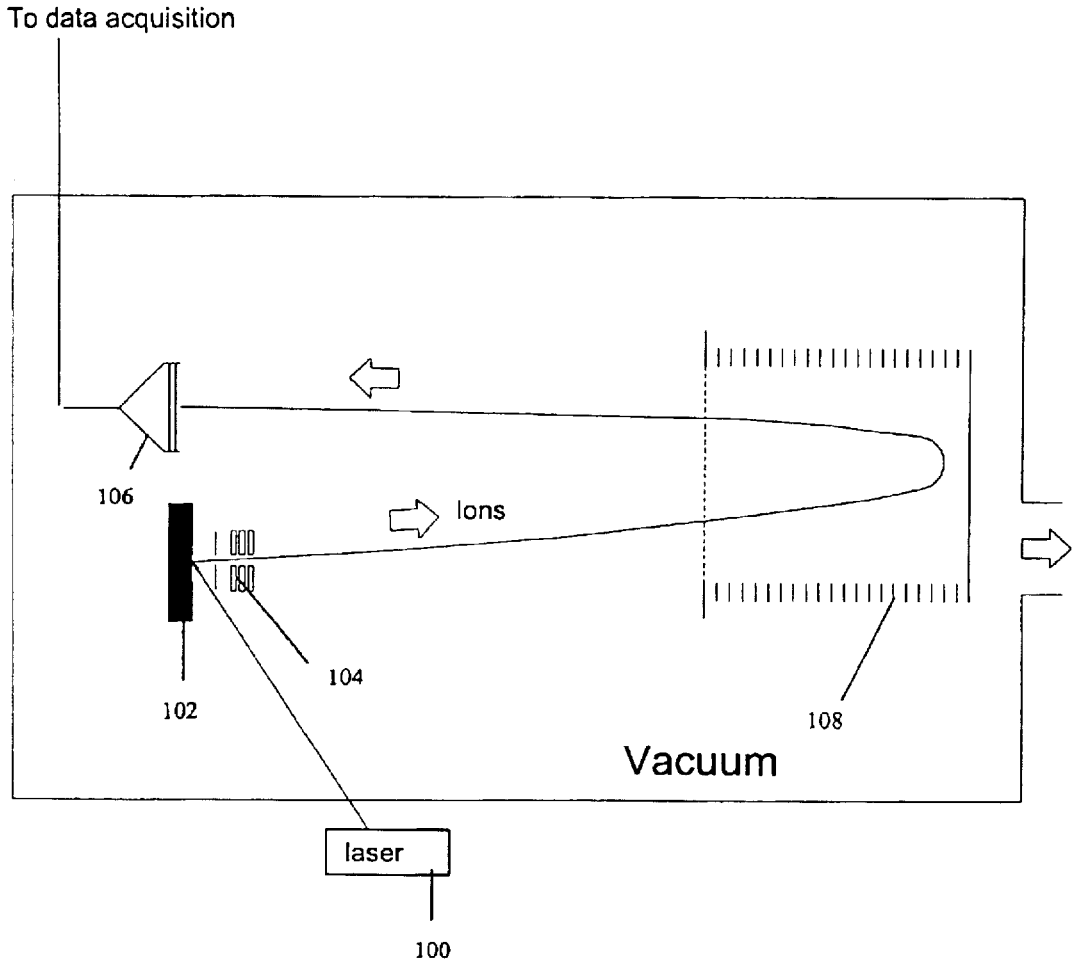
FIGURE 1B PRIOR ART
FIG. 1B is a schematic of a reflectron TOF-MS.
Figure 1C:
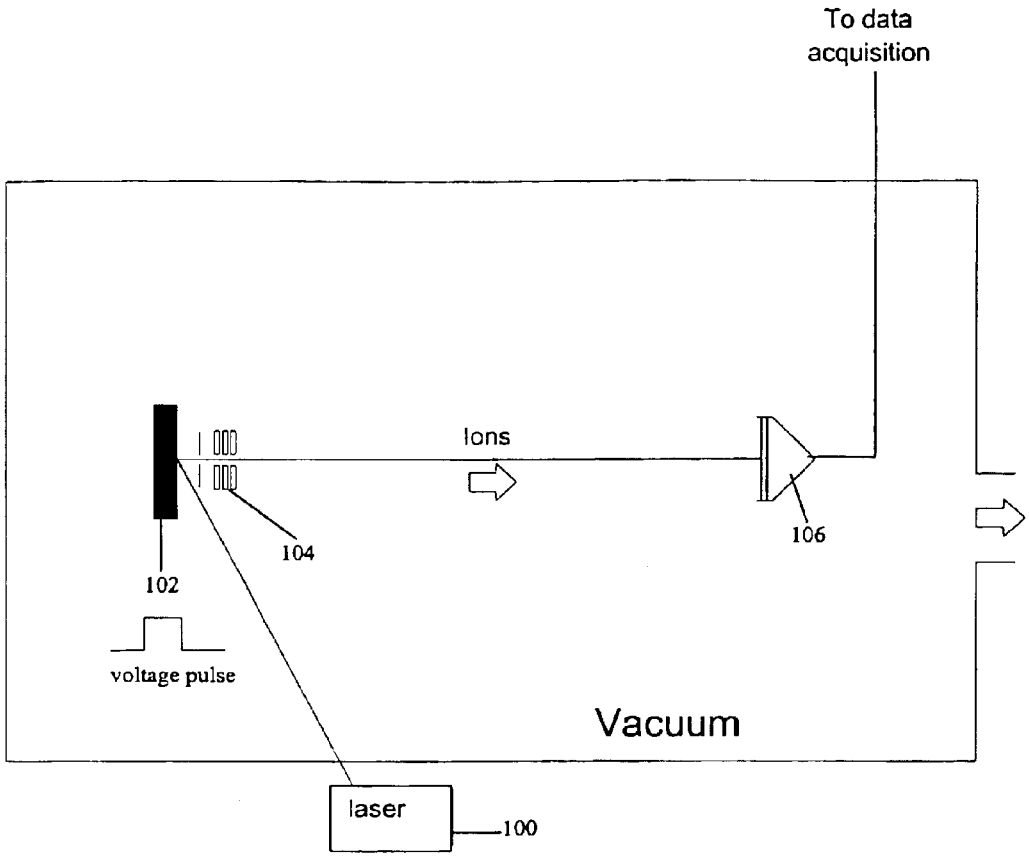
FIGURE 1C PRIOR ART
FIG. 1C is a schematic of a time lag focusing (TLF) TOF-MS.
Figure 1D:
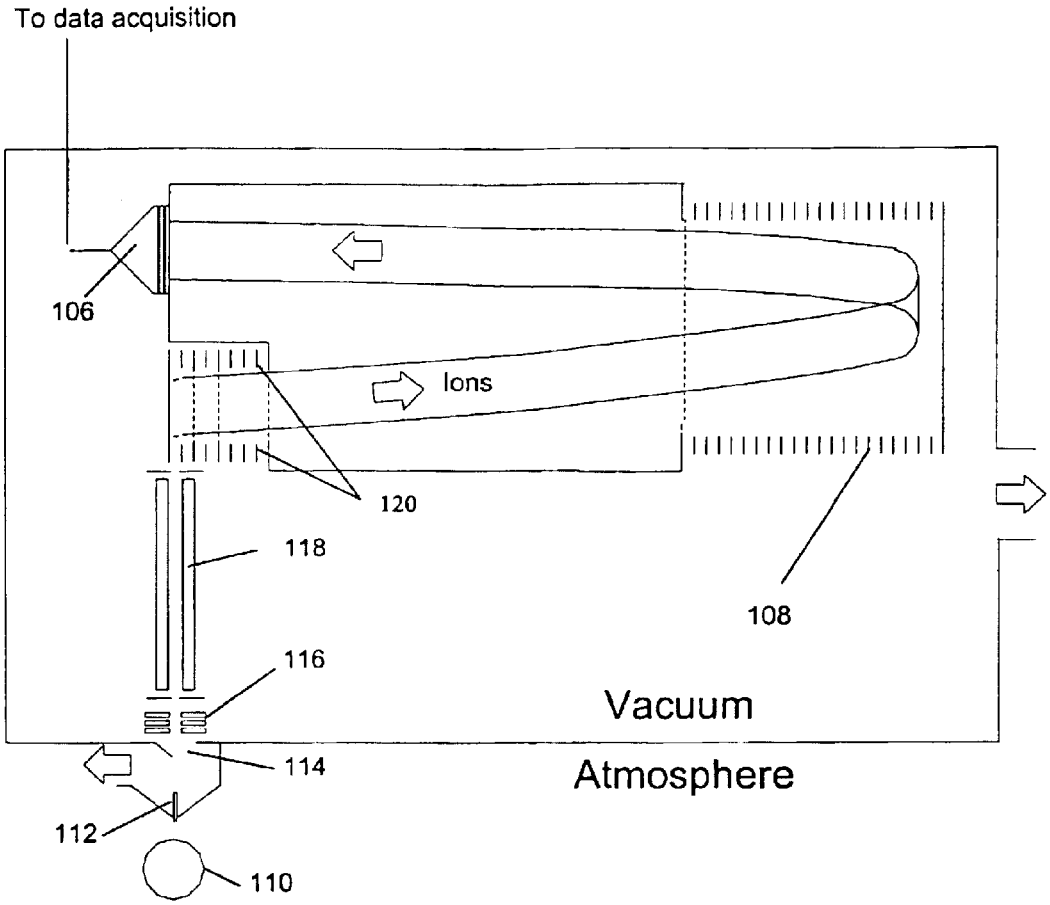
FIGURE 1D PRIOR ART
FIG. 1D is a schematic of an orthogonal acceleration TOF-MS.
Figure 2A:
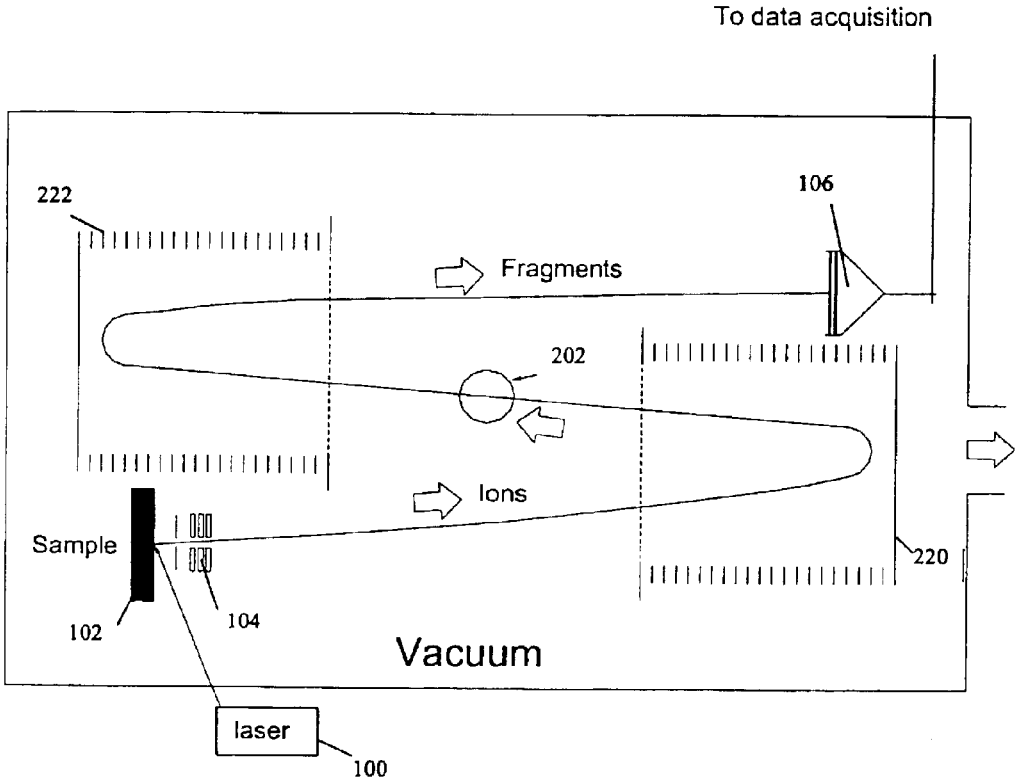
FIGURE 2A PRIOR ART
FIG. 2A is a schematic of a reflectron-TOF/reflectron-TOF-MS.
Figure 2B:
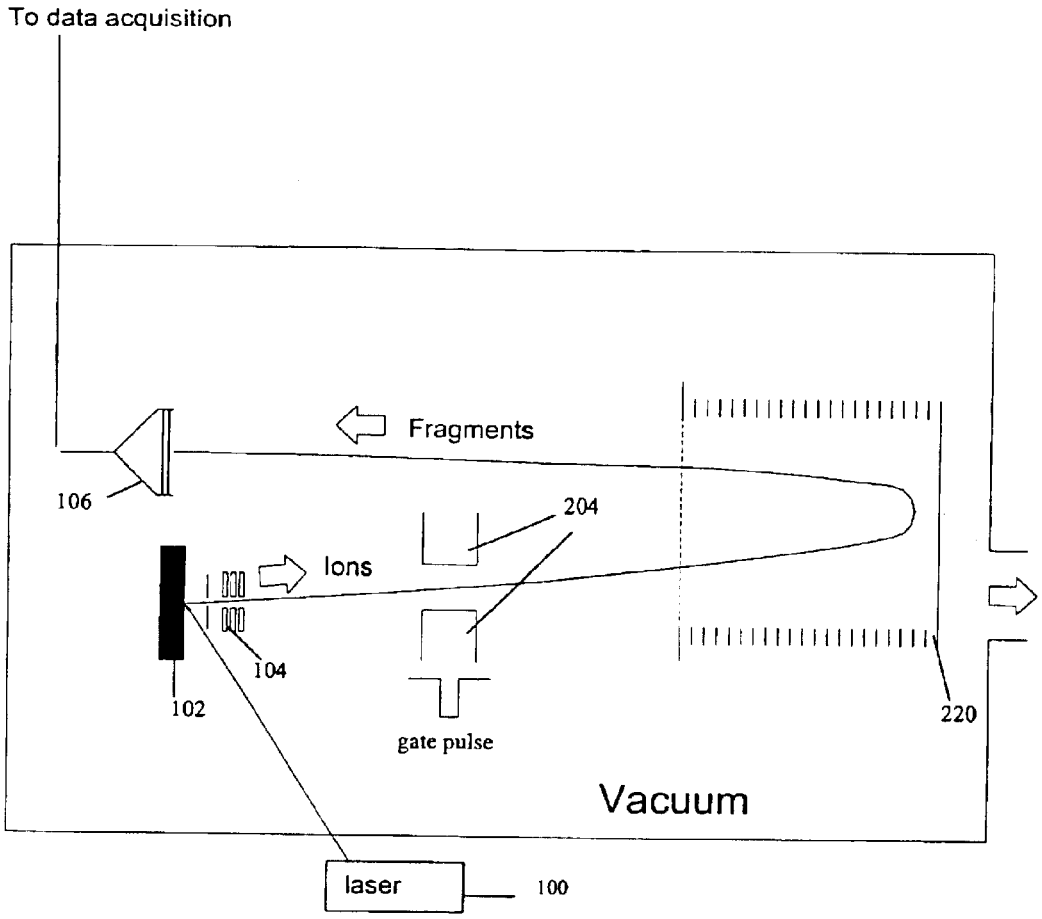
FIGURE 2B PRIOR ART
FIG. 2B is a schematic of a post-source decay (PSD) in reflectron TOF-MS.
Figure 2C:
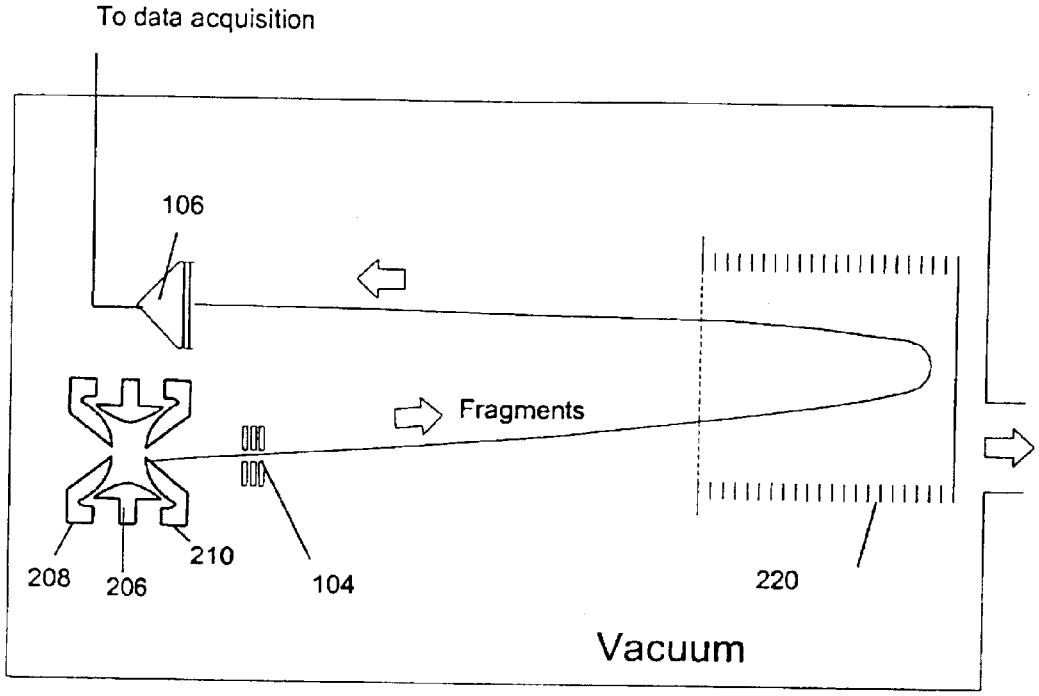
FIGURE 2C PRIOR ART
FIG. 2C is a schematic of an ion trap/TOF-MS.
Figure 2D:
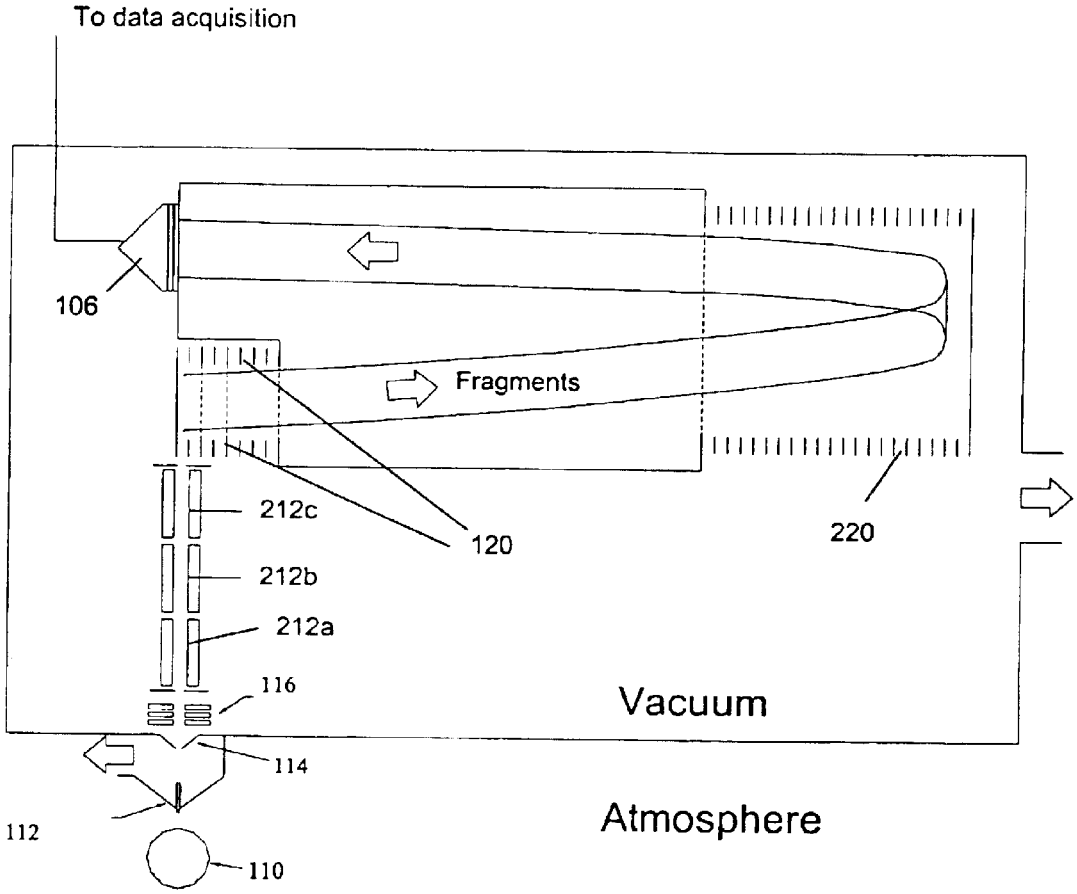
FIGURE 2D PRIOR ART
FIG. 2D is a schematic of quadrupole/orthogonal acceleration TOF-MS.
Figure 3A:
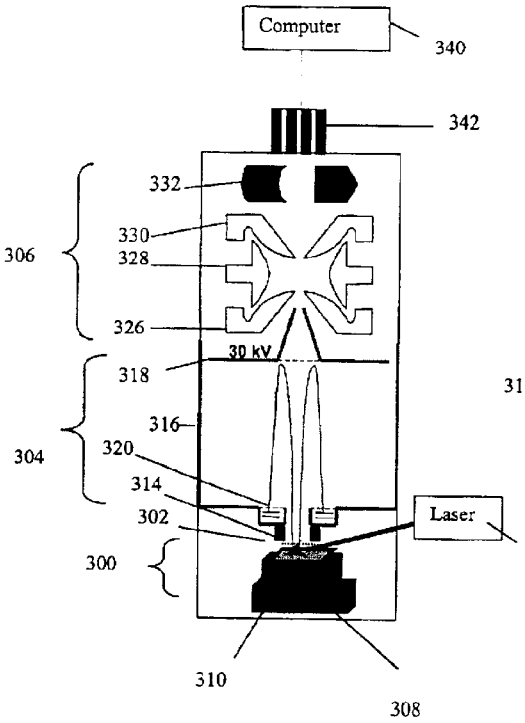
FIG. 3A is a schematic of one embodiment of the present invention with a TOF/IT-MS operated in a normal MS mode and interfaced to a vacuum MALDI ion source.
Figure 3B:
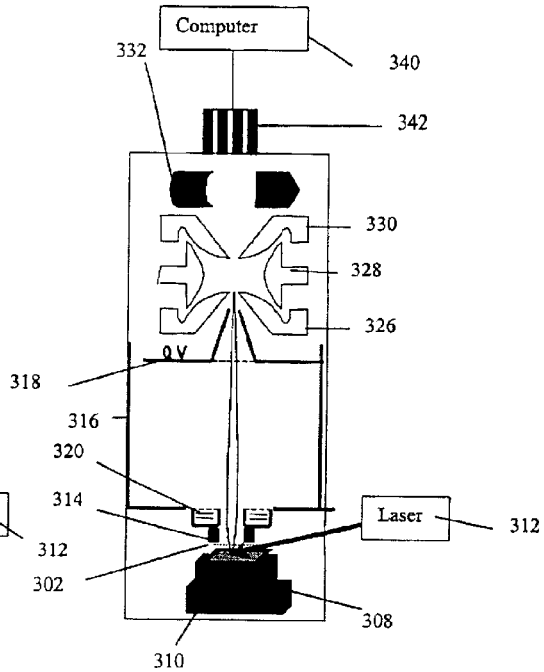
FIG. 3B is a schematic of the same embodiment of the present invention with a TOF/IT-MS operated in a tandem mode and interfaced to a vacuum MALDI ion source.

Referring now to the drawings, wherein like reference numerals designate identical, or corresponding parts throughout the several views, and more particularly to FIG. 3A thereof, FIG. 3A is a schematic of the TOF/IT-MS of the present invention operated in a normal MS mode, and FIG. 3B is a schematic of the TOF/IT-MS of the present invention operated in a tandem mode.

In one embodiment of the present invention as shown in FIGS. 3A and 3B, the TOF/IT-MS of the present invention includes an ion source 300, an extraction device 302, a time-of-flight (TOF) mass analyzer 304, an ion trap (IT) mass analyzer 306, and an ion guiding optical element (to be specified later) to direct extracted ions to either the time-off-light mass analyzer 304 or the ion trap mass analyzer 306.

FIGS. 3A and 3B both depict a TOF/IT-MS instrument utilizing a vacuum MALDI ion source as the ion source 300, but other ion sources such as those known to those skilled in the art could be used according to the present invention. The ion source 300 includes an x-y stage 308 which positions a sample 310 on the ion source 300. The sample 310 can be a multisample probe array permitting higher throughput into the TOF/IT-MS instrument. A laser 312 produces a beam directed to the sample 310. The laser 312 can be for example, either a Nitrogen gas laser ($\lambda$=337 nm, LSI, Franklin, Mass.) or a miniature all-solid-state tunable infrared (IR) optical parametric oscillator laser ($\lambda$=2.5–4.5 $\mu$m, SESI, Burtonsville, Md.), or other lasers known to those skilled in the art. The laser beam is focused onto the sample 310 using a calcium fluoride lens (not shown). The laser beam can be generated from other suitable laser sources with appropriate wavelength and power to produce desorption and ionization. The laser spot size can be focused to a spot size of 100–300 $\mu$m. An electric field exists between the sample 310 and the grounded extraction device 302 (i.e. a grounded grid located nearby the multisample array probe 312) which is located above the sample surface, for example, at a distance of 8 mm from the sample surface. The electric field established by an acceleration voltage (e.g., a +25 kV for positive ions and a −25 kV for negative ions applied to the sample 310) accelerates ions toward the TOF mass analyzer 304. An ion lens 314, by applying a focusing voltage (e.g., a +10 kV voltage), can adjust a spreading of the ions in radial direction so that extracted ions of different mass reach the detector 320. Ions are introduced into the TOF mass analyzer 304 through an entrance hole in a bottom of a reflectron cap 316 of the TOF mass spectrometer 304.

In normal operation of the TOF/IT MS of the present invention, the accelerated ions are mass separated by the TOF mass analyzer 304. The TOF mass analyzer 304 is similar to the reflectron TOF mass analyzer described in detail in U.S. Pat. No. 5,814,813, the entire contents of which are incorporated herein by references. The TOF mass analyzer 304 of the present invention can include a reflecting electrode 318 which is electrically isolated from ground. A reflecting voltage applied to the reflecting electrode 318 establishes a reflecting plane for the extracted ions. Ions which are extracted into the mass analyzer 304 travel inside the reflectron cap 316 and are reflected by the reflecting electrode 318 (e.g., with a voltage of +30 kV for positive ions and −30 kV for negative ions). The reflected ions proceed to a TOF ion detector 320. While not designed to accentuate post source decay, during the time in which the ions transit from the extraction device 302 to the TOF detector 320, some of the extracted can ions can nevertheless fragment producing ion fragments of the extracted ions.

The reflecting electrode 318 along with the reflectron cap 316 and ion lens 314 constitute an ion guiding optical element which establish either a first electric field configuration to guide a first extraction of ions in the TOF mass analyzer in the normal mode of operation or to establish a second electric field configuration to guide a second extraction of ions to the IT mass analyzer in the tandem mode of operation. These electric field configurations can be established, according to the present invention, with a voltage control device 342 which sets, among other voltages on the mass spectrometer of the present invention, a first or second control voltage on the reflecting electrode 318 and ion lens 314. As depicted in FIG. 3A, the reflectron cap 316 possess coaxial symmetry and does not involve complicated ion optics, thus permitting a relatively simplified design, miniaturization, and, due to the approximate quadratic field inside the reflectron, higher order focusing.

While not limited to the following specifications, the TOF mass analyzer 304 depicted in FIG. 3A can be about 10.16 cm in length with an ion beam aperture inside the reflectron about 2.54 cm in diameter. The ion detector 320 can be a microchannel plate (MCP) detector, such as for example a MCP detector from Hamamatsu Corporation of Japan. The reflectron cap 316 can have a diameter of about 15 cm, which results in a nearly uniform electric field within the 2.54 cm central area of the TOF mass analyzer 304.

A total length of the TOF mass analyzer 304 from the sample 310 to the reflecting electrode 318 can be about 15 cm. The MCP detector can have a 6 mm dia. hole for axial introduction of ions into the reflectron. The angular divergence of the ion beam is controlled, according to the present invention, by a voltage (e.g., up to ±10 kV) applied to the ion lens 314.

A time lag focusing method, such as for example the method disclosed in W. C. Wiley, I. H. McLaren, *Rev. Sci. Instr.,* 1955, vol. 26, pp. 1150–1157, the entire contents of which has been previously incorporated herein by reference, is used during mass analysis in the TOF mass analyzer 304 to focus ions at the entrance of the reflectron cap 316 by applying a delayed extraction pulse (e.g., a delay time of 200–1500 ns from the laser firing, with a pulse rise time of about 40 ns, a duration of 10 $\mu$s, and an amplitude up to ±25 kV) to the sample. The pulse is generated by a high voltage pulser, such as for example, a pulser from Eurotek of Morganville, Mass.

Turning to FIG. 3B, in the tandem mode operation of the TOF/IT-MS instrument of the present invention, ions which are accelerated by the extraction device 302 are not reflected by the reflecting end electrode 318 but rather are directed through the reflecting end electrode 318 into the IT mass analyzer 306 located behind the reflecting end electrode 318. In general, the voltages on the sample 310, ion lens 314, the reflecting end electrode 318 can be controlled to let the ions pass through a hole in the reflecting end electrode 318 into the ion trap mass analyzer 306. In one embodiment, a continuous extraction voltage (e.g., up to ±5 kV) is set on the sample 310 before the laser pulse; a voltage on the reflecting electrode 318 is set near zero; and ions pass through a hole in the reflecting electrode 318 into the IT mass analyzer 306. A voltage on the ion lens 314 is controlled, for example, up to ±4 kV to focus ions within the entrance aperture of the ion trap end-cap electrode 326. The entrance aperture can be a small diameter hole, e.g., 1.2 mm diameter.

The IT mass analyzer 306 includes an entrance ion trap end-cap 326, a ring electrode 328, an exit ion trap end cap 330, and an ion trap ion detector 332. For injection of ions into the ion trap, the IT mass analyzer 306 can be floated with respect to the ion source at a potential which is for example about 5–40 V below the acceleration voltage applied to the ion source 300, so that ions enter the ion trap mass analyzer 306 with a kinetic energy of 5–40eV. An ion trap device can store almost all incoming ions inside the ion trap, hence the name ion trap. To increase the trapping efficiency, an RF voltage on the ring electrode 328 can be ramped to a RF voltage, e.g., from 1 kV to 3 kV (zero-to-peak), during an injection period. As such, ions are injected and trapped in the ion trap 306. The maximum RF voltage on the ring electrode 328 can be up to 8 kV (zero-to-peak). The trapping technique can be similar to one described in U.S. Pat. No. 5,399,857, the entire contents of which have been previously incorporated herein by reference.

To obtain tandem spectra, the trapped ions undergo various processes known from the art which include, but are not limited to, steps of ion isolation (e.g., applying a combined RF and excitation voltages to the ring and end-cap electrodes), fragmentation (e.g., collisions of the ions with a buffer gas introduced into the ion trap), and fragment analysis (e.g., scanning the trap voltage or frequency parameters with subsequent detection of the ejected fragment ions by an electron multiplier located outside the trap). A narrow or wide band excitation voltage (up to 40 V, zero-to-peak) can be applied across the ion trap end-caps 326 and 330. Mass separation of ions in the IT mass analyzer 306 can be performed by either scanning the RF voltage or scanning the rf frequency on the ring electrode 328 such that ions of a specific mass range are ejected from the IT mass analyzer 306 to the ion trap detector 332. Alternatively, ion can be detected by the same ion detector 320 used for ion detection in normal MS mode of operation.

Figure 4:
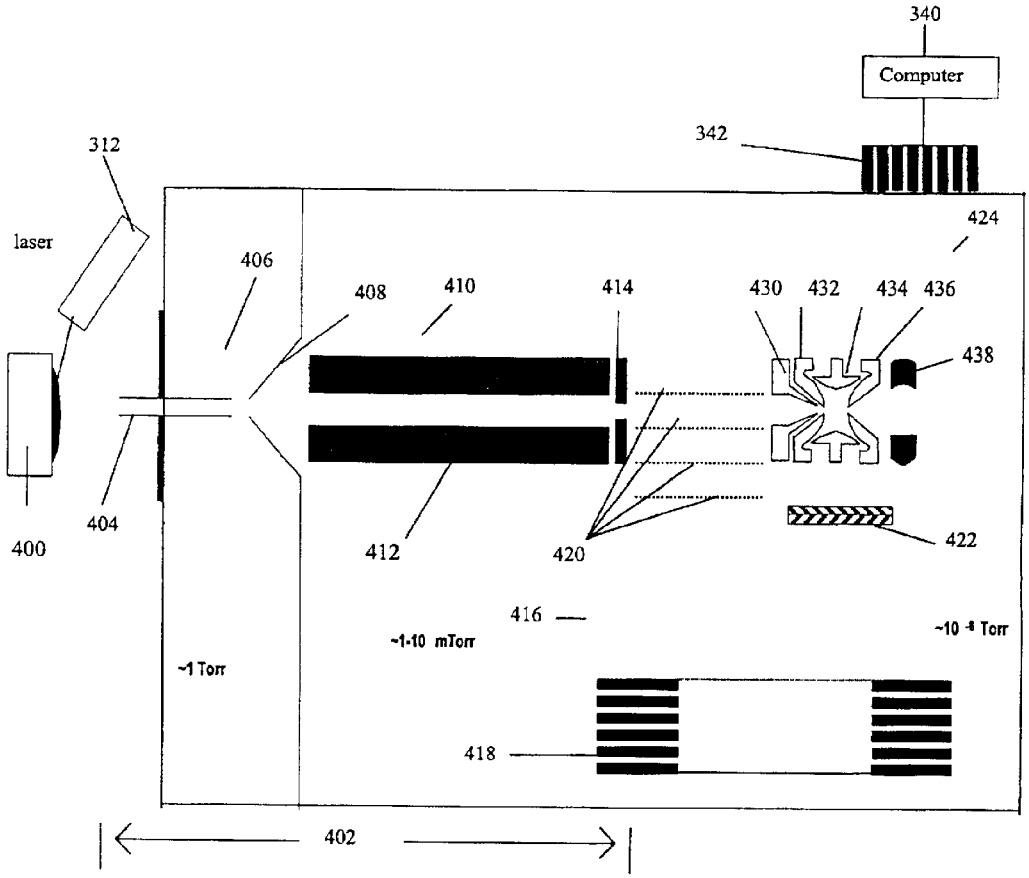
FIG. 4 is a schematic of another embodiment of the present invention with a TOF/IT-MS interfaced to an atmospheric pressure MALDI ion source.

In another embodiment of the present invention as shown in FIG. 4, an atmospheric pressure MALDI source 400 is used for the ion source. FIG. 4 illustrates an orthogonal acceleration TOF mass spectrometer. Formation of ions at atmospheric conditions imposes a different ion extraction technique and analysis than required for the vacuum MALDI apparatus in FIGS. 3A and 3B. In this embodiment, the TOF/IT MS of the present invention extracts ions from a pulsed ionized beam source with an extraction device 402. The extraction device 402 includes a heated capillary 404, a first pumped region 406, a skimmer 408 separating the first pumped region 406 and a second pumped region 410, an RF quadrupole 412 for thermalization and normalization of ion velocities, an exit ion lens 414 which separates the second pumped region 410 from a TOF mass analyzer 416. A reflectron 418 described below is not part of the extraction device 402.

In the arrangement shown in FIG. 4, the capillary 404, the skimmer 408, and the RF quadrupole 412 are differentially pumped to pressures progressively lower than atmospheric pressure. A quadrupole 412 is used for thermalization of the ion velocity in a radial direction so that, at the output of the quadrupole guide, the extracted ions form a nearly parallel beam. Thermalized ions, for normal operation, are accelerated in an orthogonal direction toward the reflectron 418. The acceleration is due to an applied electric field between the acceleration grids 420, created by periodically applying potentials to the acceleration grids 420. These electric fields can be established, according to the present invention, with the voltage control device 342 which sets, among other voltages on the mass spectrometer of the present invention, a first or second control voltage sets on the acceleration grids 420. Further in the normal mode of operation, the region between the accelerator grids 420 is filled with ions, and the ions are extracted toward the reflectron 418 for subsequent detection by a TOF detector 422. The operation of the orthogonal extraction device 402 and acceleration grid 422 can be similar to that described in Mirgorodskaya et al., Anal. Chem. vol. 66, pp. 99–107 (1994) and in Verentchikov et al., Anal. Chem. vol. 66, pp. 126–133 (1994), the entire contents of each reference are incorporated herein by reference.

In this embodiment of TOF/IT-MS of the present invention, an ion trap mass analyzer 424 is coupled to the extraction device 402 and is located along an axis of the extraction device 402 so that, for tandem operation, no pulses are applied to the acceleration grids 420, and ions in the pulsed beam pass are focused by the ion lenses 414 onto an entrance lens 430 in front of an entrance ion trap end-cap 432, a ring electrode 434, and an exit ion trap end cap 436 of the ion trap mass analyzer 424. Operation in the tandem mode of ion trap mass analyzer 424 of the present invention is similar to the operation of ion trap mass analyzer 306 described previously. The entrance lens 430, according to the present invention, is an electrostatic lens (as shown in FIG. 4), or may be replaced with a quadrupole.

In the tandem mode of operation, no field exists between the grids 420 and the extracted ion beam is focused onto the entrance ion trap end-cap 432 by ion lenses 414 and 430. The focussing of the extracted ion beam can, according to the present invention, be assisted by a quadrupole lens design similar to the entry quadrupole 412. In the tandem mode of operation, voltages on the ion lenses 414 and 430 and the grids 420 are adjusted in such a way that almost all of the ions exiting the end of the rf quadrupole 412 are focused into the ion trap mass analyzer 424. Once in the ion trap mass analyzer 424, the ion trap mass analyzer 424 isolates precursor ions of interest, fragments the precursor ions, and then separates the fragmented ions according to the m/z values, whereby ions of a predetermined mass (i.e. m/z value) can be detected by an ion detector 438. The ion detectors 320, 332, 422 and 438 can include analogue to digital converter or time-to-digital converter devices. The ion detectors use techniques known in the art such as secondary electron multipliers and multichannel plates to amplify the detected ion flux.

Figure 5:
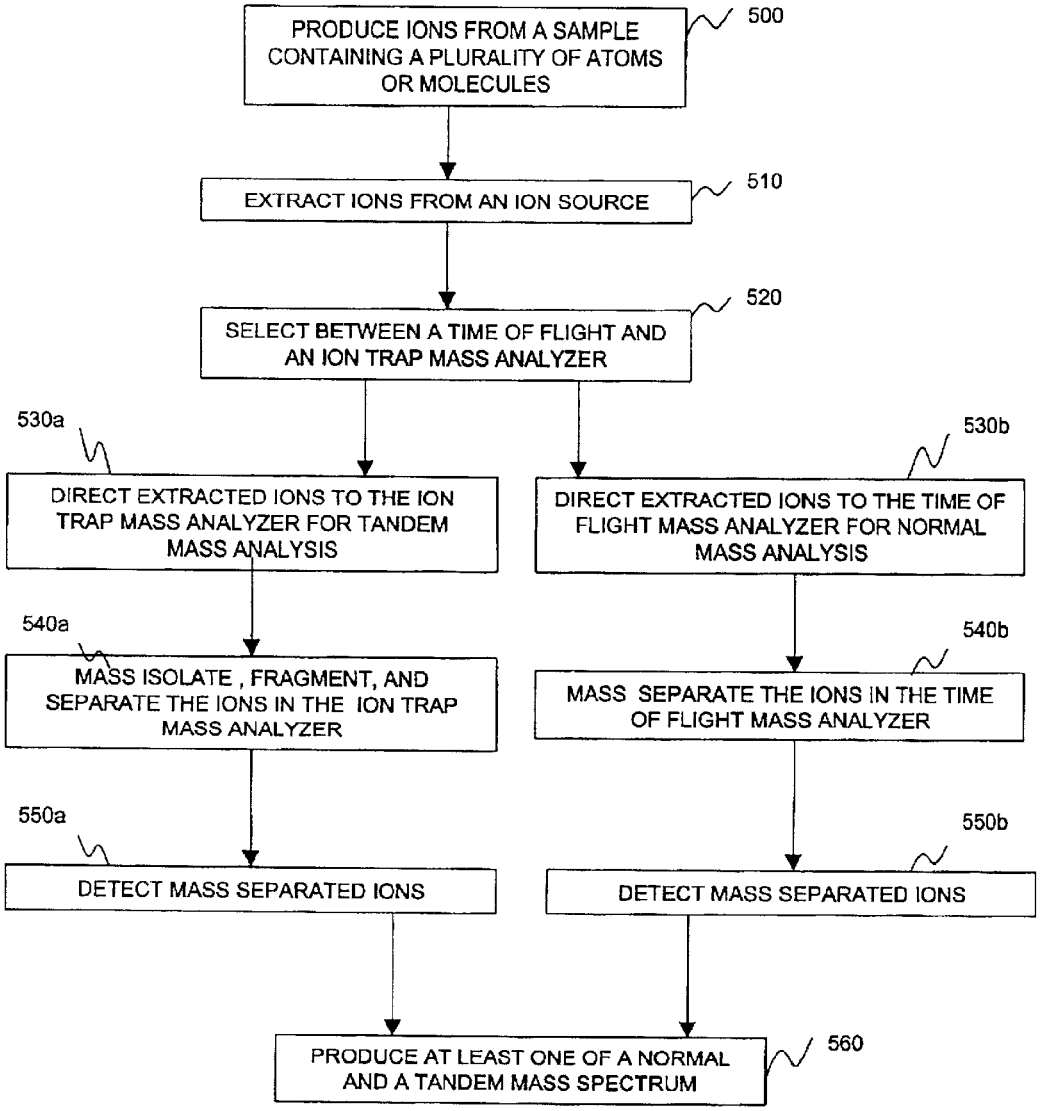
FIG. 5 is a flowchart showing a process for obtaining a mass spectrum according to the present invention.

A method of the present invention as shown in FIG. 5 produces both normal and tandem spectra. At step 500, ions are produced from a sample containing a plurality of atoms or molecules (e.g., a MALDI source or an electroscopy imization source). At step 510, the ions are extracted from an ion source. At step 520, a mass analyzer is selected between a time-of-flight mass analyzer and an ion trap mass analyzer. At steps 530*a* and 530*b*, the extracted ions (or fragments of the extracted ions) are directed into the selected mass analyzer. At step 540*a*, the extracted ions (or the fragments of the extracted ions) are mass isolated, further fragmented, and separated according to a mass-to-charge ratio. At step 540*b*, the extracted ions (or the fragments of the extracted ions) are mass separated according to a mass-to-charge ratio. At steps 550*a* and 550*b*, the mass-separated ions are detected with the selected mass analyzer. At step 560, at least one of a normal mass spectrum and a tandem mass spectrum is produced by the selected mass analyzer.

According to the present invention, at step 510, positive ions can be extracted from the ion source by applying a positive voltage to the stage 308 while grounding the nearby extraction device 302, or negative ions can be extracted by conversely applying a negative voltage to the sample stage. The extracting step 510 can use a time-lag focusing technique which applies an extraction voltage pulse to the stage 308 to begin a simultaneous extraction of a pulse of ions. Once extracted, the ion pulse can be directed at step 530 to a TOF or an ion trap mass analyzer or both.

Once extracted, the extracted ions at step 530*b* can be directed by applying a first controllable voltage to the ion guiding optical element (e.g., the reflecting end electrode 318 or the acceleration grids 420) to direct a first extraction of the extracted ions to the time-of-flight mass analyzer (e.g., 304 or 416). Alternatively, the extracted ions at step 530*a* can be directed by applying a second controllable voltage to the ion guiding optical element (e.g., the reflecting end electrode 318 or the acceleration grids 420) to direct a second extraction of the extracted ions to the ion trap mass analyzer (e.g., 304 or 424). During the steps of extracting, selecting, and directing, the first and second extractions can fragment into smaller ions which are directed to the selected mass analyzer.

In one embodiment of the present invention, time-of flight mass separation occurs at step 540*b* in a TOF mass analyzer (e.g., TOF mass analyzer 304) such that a reflecting potential is applied to reflect the ions extracted from the ion source (e.g., ion source 300) to an ion detector (e.g., ion detector 320).

In another embodiment of the present invention, time-of flight mass separation occurs at step 540*b* using an orthogonal acceleration TOF mass analyzer (e.g., TOF mass spectrometer 400) such that ions extracted from an atmospheric ion source (e.g. ion source 400) are accelerated orthogonal to an axis of an extraction device (e.g., extraction device 402) by application of periodic potentials to acceleration grids (e.g., grids 420). The accelerated ions are reflected by a reflectron (e.g., reflectron 424) to an ion detector (e.g., TOF ion detector 422).

In still another embodiment of the preset invention, ion trap mass isolation, fragmentation, and separation occurs at step 540*a* in a quadrupole ion trap mass analyzer (e.g., ion trap mass analyzer 324 or 424) whereby voltages between entrance and exit ion trap end caps are generated, RF voltage or frequency on a ring electrode of the ion trap mass analyzer are scanned.

Alternatively, in another embodiment of the present invention, mass separation at step 540*b* occurs after ion fragmentation in an ion trap and subsequent ejecting of the fragmented ions into a linear TOF mass analyzer (e.g., by simultaneously ejecting ions from the ion trap 324 backwards to the ion detector 320 in the TOF mass analyzer 304).

The method of operating the mass spectrometer and the data acquisition, including switching between the normal and tandem modes, timing and voltage setting and control, data accumulation and processing, can be controlled according to the present invention by a computer 340. The computer 340 interfaces to the mass spectrometer of the present invention through the afore-mentioned voltage control device 342. Through the voltage control device, the computer 340 can control and synchronize the laser pulsing. The computer 340 can control voltages applied to the ion source (300 or 400), the extraction device (302 or 402), the TOF ion detectors (320 or 422), the IT ion detectors (332 or 438), the trapping optics (326–330 or 432–436), the ion guiding optical element (318 or 420), the rf quadrupole (412), and/or the reflectron 418 of the present invention. The computer 340 can record from the ion detectors the normal and tandem mass spectra.

Figure 6:
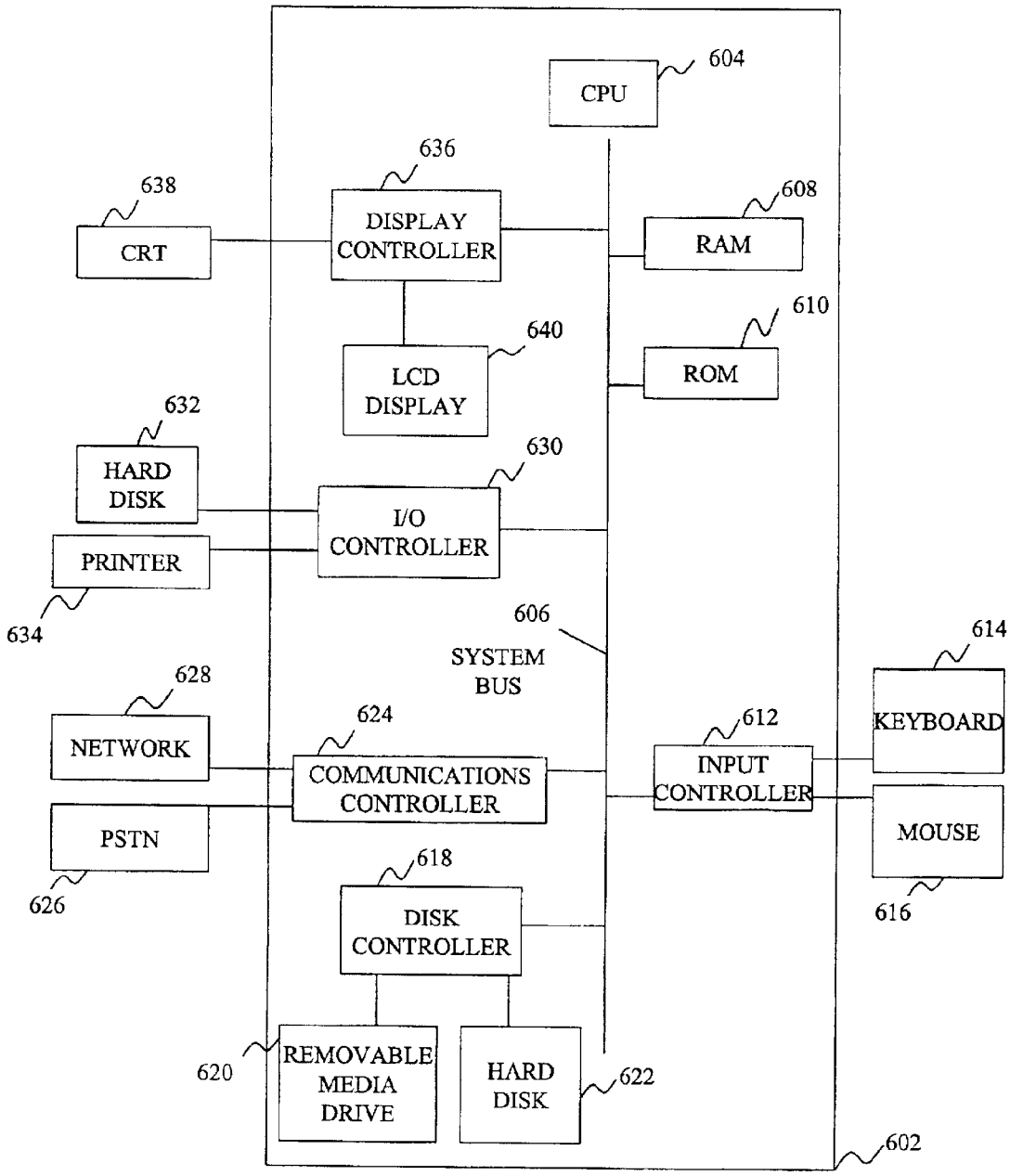
FIG. 6 is a schematic illustration of a computer system programmed to perform one or more of the special purpose functions of the present invention.

FIG. 6 is a block diagram of an exemplary computer 602 such as for example the computer 340 shown in FIGS. 3A, 3B, and 4 that may be programmed to perform one or more of the special purpose functions of the present invention. The computer 602 is a personal computer, a portable computer, a computer workstation with sufficient memory and processing capability, or any device configured to work like a computer. In one embodiment, the computer 602 is a device diagrammatically shown in FIG. 6. In this embodiment, the computer 602 includes a central processing unit 604 (CPU) that communicates with a number of other devices by way of a system bus 606. The computer 602 includes a random access memory (RAM) 608 that stores temporary values used in implementing the process control steps for the mass spectrometer of the present invention.

The central processing unit 604 is configured for high volume data transmission for performing a significant number of mathematical calculations in controlling the mass spectrometer of the present invention. A Pentium III microprocessor such as the 1 GHz Pentium III manufactured by Intel Inc. may be used for CPU 604. The processor employs a 32-bit architecture. Other suitable processors include the Motorola 500 MHZ Power PC G4 processor and the Advanced Micro Devices 1 GHz AMD Athlon processor. Multiple processors and workstations may be used as well.

A ROM 610 is preferably included in a semiconductor form although other read only memory forms including optical medium may be used to host application software and temporary results. The ROM 610 connects to the system bus 606 for use by the CPU 604. The ROM 610 includes computer readable instructions that, when executed by the CPU 604, perform different functions associated with controlling the mass spectrometer of the present invention. An input control 612 connects to the system bus 606 and provides an interface with various peripheral equipment including a keyboard 614 and a pointing device such as a mouse 616 settles to permit user interaction with graphical user interfaces. The input controller 612 may include different ports such as a mouse port in the form of a PS2 port or, for example, a universal serial bus (USB) port. The keyboard port for the input controller 612 can be in the form of a mini-DIN port although other connectors may be used as well. The input controller 612 may also include serial ports or parallel ports as well.

A disc controller 618 is in the form of an IDE controller and connects via driving cables to a removal media drive 620 which may be implemented as a floppy disc drive, as well as a hard disc drive 622 and a CD-ROM drive (not shown). In addition, a PCI expansion slide is provided on a disc controller 618, a motherboard that hosts the CPU 604. An enhanced graphic port expansion slot is provided and provides 3-D graphics with fast access to the main memory. The hard disc 622 may also include a CD drive that may be readable as well as writable. A communication controller 624 provides a connection to a network 628, which can be a local area network, wide area network, a virtual private network (VPN), or an extranet. The communications controller 624 can also provide a connection to a public switched telephone network (PSIN) 626 for providing Internet access. In one embodiment, the networks 628 and 626 and the communication controller 624 are connected by way of a plurality of connections including a cable-modem connection, digital subscriber line (DSL) connection, fiber optic connection, dial-up modem connection, and the like that connects to the communication controller 624.

An input/output controller 630 also provides connections to the external components such as an external hard disc drive 632, a printer 634, for example, by way of an RS 232 port and a CSI bus. The input/output controller 630 can be connected to the TOF and the IT mass analyzers, the ion optics, and the laser and x-y stage controls of the present invention.

A display controller 636 interconnects the system bus 606 to a display device, such as a cathode ray tube (CRT) 638. The CRT can be used for display of both the normal and tandem mass spectrum as well as providing information about the operational status of the mass spectrometer (e.g., control voltages, MALDI source expiration, laser pulse, ion flux, vacuum level, etc.) While a CRT is shown, a variety of display devices may be used such as an LCD (liquid crystal display) 640, or plasma display device. Display device permits displaying of graphical user interfaces.

The present invention thus also includes a computer-based product that may be hosted on a storage medium and include instructions that can be used to program a computer to perform a process in accordance with the present invention. This storage medium can include, but is not limited to, any type of disk including floppy disks, optical disks, CD-ROM, magneto-optical disks, ROMs, RAMs, EPROMs, EEPROMs, Flash Memory, Magnetic or Optical Cards, or any type of media suitable for storing electronic instructions.

This invention may also be conveniently implemented using a conventional general purpose digital computer programmed according to the teachings of the present specification, as will be apparent to those skilled in the computer art. Appropriate software coding can readily be prepared by skilled programmers based on the teachings of the present disclosure as will be apparent to those skilled in the software art. In particular, the computer program product controlling the operation of the mass spectrometer of the present invention can be written in a number of computer languages including but not limited to C,C+, Fortan, and Basic, as would be recognized by those of ordinary skill in the art. The invention may also be implemented by the preparation of applications specific integrated circuits or by interconnecting an appropriate network of conventional component circuits, as will be readily apparent to those skilled in the art.

Numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A mass spectrometer, comprising:

an ion source configured to produce ions from a sample;

an extraction device configured to extract ions from the ion source;

a time-of-flight (TOF) mass analyzer configured to analyze and detect said ions in a normal mass spectrometer mode of operation;

an ion trap (IT) mass analyzer configured to analyze and detect said ions in a tandem mass spectrometer mode of operation; and an ion guiding element configured to direct a first extraction of said ions alone a curved trajectory into the TOF mass analyzer in the normal mass spectrometer mode of operation, and configured to guide a second extraction of said ions into the IT mass analyzer in the tandem mass spectrometer mode of operation.

2. The spectrometer as in claim 1, wherein the ion source comprises:

an array of samples.

3. The spectrometer as in claim 1, wherein the ion source comprises:

a vacuum matrix-assisted laser desorption/ionization (MALDI) source.

4. The spectrometer as in claim 1, wherein the ion source is configured to produce ions at normal atmospheric pressure.

5. The spectrometer as in claim 4, wherein the ion source comprises:

an electrospray ionization source.

6. The spectrometer as in claim 4, wherein the ion source comprises:

an atmospheric pressure MALDI source.

7. The spectrometer as in claim 1, wherein the extracting device is configured to time-lag focus extracted ions.

8. The spectrometer as in claim 1, wherein the TOF mass analyzer comprises:

a TOF ion detector configured to detect the first extraction and ion fragments of said first extraction, and time-of-flight optics configured to direct the first extraction and said ion fragments of the first extraction to the TOF ion detector and to mass-separate the first extraction and said ion fragments of the first extraction according to a mass-to-charge ratio.

9. The spectrometer as in claim 8, wherein the time-of-flight optics comprises:

an acceleration grid configured to accelerate the first extraction and said ion fragments of said first extraction orthogonally to an axis of the extraction device; and a reflectron configured to reflect accelerated ions towards the TOF ion detector.

10. The spectrometer as in claim 8, wherein the time-of-flight optics comprises:

a reflectron.

11. The spectrometer as in claim 10, wherein the reflectron is an end-cap reflectron comprising:

a cap of the reflectron; and a reflecting end electrode electrically isolated from the cap and configured to reflect the first extraction and said ion fragments of said first extraction to the TOF ion detector.

12. The spectrometer as in claim 11, wherein the cap is configured with a through-hole to permit said second extraction and said ion fragments of said second extraction to transit through the TOF mass analyzer and enter the IT mass analyzer.

13. The spectrometer as in claim 1, wherein the TOF mass analyzer comprises:

a linear TOF mass analyzer.

14. The spectrometer as in claim 13, wherein the linear TOF mass analyzer is configured to transit said first extraction and ion fragments of said first extraction through said TOF mass analyzer and through said IT mass analyzer and detect transited ions by an IT ion detector.

15. The spectrometer as in claim 1, wherein the IT mass analyzer comprises:

an IT ion detector configured to detect said second extraction and ion fragments of said second extraction, and trapping optics configured to trap a portion of said second extraction in a trapping electric field, to isolate and fragment trapped ions, to mass separate the trapped ions according to a mass-to-charge ratio, and to direct trapped ions of a predetermined mass-to-charge ratio to the IT ion detector.

16. The spectrometer as in claim 15, wherein the IT mass analyzer comprises:

a quadrupole ion trap mass analyzer, including,
a ring electrode,
an entrance ion trap end cap, and
an exit ion trap end cap, whereby voltages on the ring electrode, the entrance and exit end caps confine ions in the ion trap and activate or eject confined ions in the ion trap to the ion trap detector.

17. The spectrometer as in claim 1, wherein the TOF ion analyzer and the IT ion analyzer utilize a single ion detector.

18. The spectrometer as in claim 1, wherein the ion guiding element is configured to establish a first electric field configuration to guide said first extraction and ion fragments of said first extraction in the TOF mass analyzer in the normal mode of operation and to establish a second electric field configuration to guide said second extraction and ion fragments of said second extraction to the IT mass analyzer in the tandem mode of operation.

19. The spectrometer as in claim 1, wherein the ion guiding element comprises:

at least one optical element of the extraction device, the TOF mass analyzer, and the IT mass analyzer.

20. The spectrometer as in claim 1, wherein the ion guiding element comprises at least one multipole ion guide.

21. The spectrometer as in claim 1, further comprising:

a computer configured to control operational voltages on at least one of the ion source, the extraction device, the TOF mass analyzer, and the ion guiding optical element.

22. A method of operating a mass spectrometer, comprising the steps of:

producing ions from a sample containing a plurality of atoms or molecules;

extracting the ions from an ion source;

selecting between a time-of-flight mass analyzer and an ion trap mass analyzer;

directing extracted ions along a curved trajectory into the time-of-flight mass analyzer when the time-of-flight mass analyzer is selected and directing the extracted ions to the ion trap mass analyzer when the ion trap mass analyzer is selected; and producing a normal mass spectrum when the time-of-flight mass analyzer is selected and a tandem mass spectrum when the ion trap mass analyzer is selected.

23. The method as in claim 22, wherein the step of producing ions comprises:

producing ions from an array of samples to increase sample analysis throughput.

24. The method as in claim 22, wherein the step of producing ions comprises:

producing the ions from a vacuum matrix-assisted laser desorption/ionization MALDI source.

25. The method as in claim 22, wherein the step of producing ions from a vacuum MALDI source comprises:

providing a laser pulse on the sample to desorb and ionize a portion of the plurality of atoms or molecules from the sample.

26. The method as in claim 22, wherein the step of producing ions comprises:

producing ions at normal atmospheric pressure.

27. The method as in claim 26, wherein the step of producing ions at normal atmospheric pressure comprises:

producing ions from an electrospray ionization source.

28. The method as in claim 26, wherein the step of producing ions from an ion source at normal atmospheric pressure comprises:

producing ions from an atmospheric pressure MALDI source.

29. The method as in claim 28, wherein the step of producing ions from an atmospheric pressure MALDI source comprises:

providing a laser pulse on the sample to desorb and ionize a portion of the plurality of atoms or molecules from the sample.

30. The method as in claim 22, wherein the step of extracting the ions comprises:

applying a positive voltage to a sample stage to extract positive ions.

31. The method as in claim 22, wherein the step of extracting the ions comprises:

applying a negative voltage to a sample stage to extract negative ions.

32. The method as in claim 22, wherein the step of extracting the ions comprises:

extracting the ions utilizing a time-lag focusing technique.

33. The method as in claim 32, wherein the step of extracting the ions utilizing a time-lag focusing technique comprises:

applying an extraction voltage pulse on a sample stage after a laser pulse desorbs and ionizes a portion of said plurality of atoms or molecules to produce said ions.

34. The method as in claim 22, wherein the step of selecting comprises:

applying a first controllable voltage to an ion guiding optical element to direct extracted ions to the time-of-flight mass analyzer.

35. The method as in claim 22, wherein the step of directing comprises:

guiding at least one of the extracted ions and ion fragments of the extracted ions with at least one optical element of the TOF mass analyzer and the IT mass analyzer.

36. The method as in claim 22, wherein the step of directing comprises:

guiding at least one of the extracted ions and ion fragments of the extracted ions with multipole ion guides.

37. The method as in claim 22, wherein the step of directing comprises:

directing at least one of the extracted ions and said ion fragments of the extracted ions by orthogonally accelerating the extracted ions.

38. The method as in claim 37, wherein the step of directing by orthogonally accelerating the extracted ions comprises:

accelerating at least one of the extracted ions and said ion fragments of the extracted ions orthogonal to an axis of an extraction device.

39. The method as in claim 37, wherein the step of accelerating orthogonal to an axis of the extraction device comprises:

applying periodically potentials between acceleration grids located on an axis with the extraction device.

40. The method as in claim 22, wherein the step of producing comprises:

mass-separating the directed ions and ion fragments of the directed ions with a linear TOF mass analyzer.

41. The method as in claim 40, wherein the step of mass-separating with a linear TOF mass analyzer comprises:

guiding at least one of the extracted ions and said ion fragments of the extracted ions through said TOF mass analyzer and through said IT mass analyzer; and detecting guided ions and fragments of the guided ions by an IT ion detector.

42. The method as in claim 22, wherein the step of producing comprises:

mass-separating the directed ions and ion fragments of the directed ions with a reflectron TOF mass analyzer.

43. The method as in claim 42, the step of mass-separating with a reflectron TOF mass analyzer comprises:

applying a reflecting potential to a reflecting electrode of the reflectron TOF mass analyzer;

reflecting at least one of the extracted ions and said fragments of the extracted ions; and detecting reflected ions and ion fragments of said reflected ions with a TOF ion detector.

44. The method as in claim 22, wherein the step of selecting comprises:

applying a second controllable voltage to an ion guiding element to direct at least one of the extracted ions and ion fragments of the extracted ions to the ion trap analyzer.

45. The method as in claim 22, wherein the step of producing comprises:

trapping said at least one of the extracted ions and fragments of the extracted ions in an ion trap; and mass-isolating and mass-fragmenting trapped ions.

46. The method as in claim 45, wherein the step of trapping with an ion trap comprises:

scanning a trapping field between an entrance ion trap end cap, an exit ion trap end cap, and a ring electrode of a quadrupole ion trap mass analyzer.

47. The method as in claim 45, wherein the step of trapping with an ion trap comprises:

scanning in frequency a radio frequency signal on a ring electrode of a quadrupole ion trap mass analyzer.

48. The method as in claim 45, wherein the step of trapping with an ion trap comprises:

scanning in voltage a radio frequency signal on a ring electrode of a quadrupole ion trap mass analyzer.

49. The method as in claim 22, wherein the step of producing comprises:

utilizing a single ion detector as both an TOF ion detector and an IT ion detector.

50. A mass spectrometer, comprising:

means for producing ions from an ion source including a sample containing a plurality of atoms or molecules;

means for extracting the ions from the ion source;

means for selecting between a time-of-flight mass analyzer and an ion trap mass analyzer;

means for directing extracted ions alone a curved trajectory into the time of flight mass analyzer when the time-of-flight mass analyzer is selected, said means for directing configured to direct the extracted ions to the ion trap mass analyzer when the ion trap mass analyzer is selected; and means for producing a normal mass spectrum when the time-of-flight mass analyzer is selected and a tandem mass spectrum when the ion trap mass analyzer is selected.

51. The spectrometer as in claim 50, wherein the means for producing ions comprises:

means for producing ions from an array of samples to increase sample analysis throughput.

52. The spectrometer as in claim 50, wherein the means for producing ions comprises:

means for producing the ions from a vacuum matrix-assisted laser desorption/ionization (MALDI) source.

53. The spectrometer as in claim 50, wherein the means for producing ions from a vacuum MALDI source comprises:

means for desorbing and ionizing a portion of the plurality of atoms or molecules from the sample.

54. The spectrometer as in claim 50, wherein the means for producing ions comprises:

means for producing the ions at normal atmospheric pressure.

55. The spectrometer as in claim 50, wherein the means for extracting the ions comprises:

means for extracting the ions utilizing a time-lag focusing technique.

56. The spectrometer as in claim 50, wherein the means for selecting comprises:

means for guiding at least one of the extracted ions and said ion fragments of the extracted ions to at least one of the time-of-flight mass analyzer and the ion-trap mass analyzer.

57. The method as in claim 50, wherein the means for directing comprises:

means for guiding at least one of the extracted ions and ion fragments of the extracted ions with a guiding element from at least one of the TOF mass analyzer and the IT mass analyzer.

58. The spectrometer as in claim 50, wherein the means for directing comprises:

means for guiding at least one of the extracted ions and ion fragments of the extracted ions with a multipole ion guide.

59. The spectrometer as in claim 50, wherein the means for directing comprises:

means for accelerating orthogonal to an axis of the means for extracting at least one of the extracted ions and ion fragments of the extracted ions, to the TOF mass analyzer.

60. The spectrometer as in claim 50, wherein the means for producing comprises:

means for reflecting at least one of the extracted ions and ion fragments of the extracted ions to the means for detecting.

61. The spectrometer as in claim 50, wherein the means for producing comprises:

means for scanning a voltage on said means for mass-separating.

62. The spectrometer as in claim 50, wherein the means for producing comprises:

means for scanning in frequency a radio frequency signal on said means for mass-separating.

63. The spectrometer as in claim 50, wherein the means for producing comprises:

means for scanning in voltage a radio frequency signal on said means for mass-separating.

64. The spectrometer of claim 1, wherein said ion guiding element is configured to reflect the first extraction in a direction opposite to a direction of the first extraction.

65. The method of claim 22, wherein the directing comprises:

reflecting the first extraction in a direction opposite to a direction of the first extraction.

66. The spectrometer of claim 50, wherein said means for directing is configured to reflect the first extraction in a direction opposite to a direction of the first extraction.

67. The spectrometer of claim 1, wherein said ion guiding element is configured to direct the first extraction at least orthogonally along the curved trajectory.

68. The method of claim 22, wherein the directing comprises:

reflecting the first extraction at least orthogonally along the curved trajectory.

69. The spectrometer of claim 50, wherein said means for directing is configured to reflect the first extraction at least orthogonally along the curved trajectory.

70. The spectrometer of claim 1, wherein said ion guiding element is configured to direct the first extraction about orthogonally along the curved trajectory.

71. The method of claim 22, wherein the directing comprises:

reflecting the first extraction about orthogonally along the curved trajectory.

72. The spectrometer of claim 50, wherein said means for directing is configured to reflect the first extraction about orthogonally along the curved trajectory.

73. The spectrometer of claim 1, wherein the TOF mass spectrometer is configured to produce in said normal mass spectrometer mode of operation a full mass range spectrum of the first extraction, and the IT mass analyzer is configured to produce in said tandem mass spectrometer mode of operation a reduced mass range spectrum of the second extraction, said reduced mass range spectrum reduced in mass range relative to the full mass range spectrum.

74. The method of claim 22, wherein the producing a normal mass spectrum comprises:

producing a full mass range spectrum of the first extraction; and producing a reduced mass rage spectrum of the second extraction, said reduced mass range spectrum reduced in mass range relative to the full mass range spectrum.

75. The spectrometer of claim 50, wherein said means for producing is configured to produce a full mass range spectrum of the first extraction and to produce a reduced mass rage spectrum of the second extraction, said reduced mass range spectrum reduced in mass range relative to the full mass range spectrum.

76. A mass spectrometer, comprising:

an ion source configured to produce ions from a sample;

an extraction device configured to extract ions from the ion source;

a time-of-flight (TOF) mass analyzer configured to analyze and detect said ions in a normal mass spectrometer mode of operation;

an ion trap (IT) mass analyzer configured to analyze and detect said ions in a tandem mass spectrometer mode of operation; and an ion guiding element disposed in front of both the TOF mass analyzer and the IT mass analyzer, said ion guiding element configured to guide a first extraction of said ions into the TOF mass analyzer in the normal mass spectrometer mode of operation, and configured to guide a second extraction of said ions into the IT mass analyzer in the tandem mass spectrometer mode of operation.

* * * * *